US011322080B1

(12) United States Patent
Wu

(10) Patent No.: US 11,322,080 B1
(45) Date of Patent: May 3, 2022

(54) IMAGE DISPLAY SYSTEM

(71) Applicant: Himax Technologies Limited, Tainan (TW)

(72) Inventor: Tung Ying Wu, Tainan (TW)

(73) Assignee: Himax Technologies Limited, Tainan (TW)

( * ) Notice: Subject to any disclaimer, the term of this patent is extended or adjusted under 35 U.S.C. 154(b) by 0 days.

(21) Appl. No.: 17/107,603

(22) Filed: Nov. 30, 2020

(51) Int. Cl.
*G09G 3/3225* (2016.01)

(52) U.S. Cl.
CPC ..... *G09G 3/3225* (2013.01); *G09G 2320/029* (2013.01); *G09G 2320/0276* (2013.01); *G09G 2320/043* (2013.01)

(58) Field of Classification Search
None
See application file for complete search history.

(56) References Cited

U.S. PATENT DOCUMENTS

2003/0058229 A1* 3/2003 Kawabe ..... G09G 3/3648 345/204
2009/0295706 A1* 12/2009 Feng ..... G09G 3/342 345/102
2010/0039557 A1* 2/2010 Mori ..... H04N 5/145 348/459
2021/0065621 A1* 3/2021 Lee ..... G09G 3/3426

* cited by examiner

*Primary Examiner* — Christopher J Kohlman
(74) *Attorney, Agent, or Firm* — Donald E. Stout; Stout, Uxa & Buyan, LLP

(57) ABSTRACT

An image display system includes a motion detection device that detects motion of an object in an input image; and a black data insertion device that inserts black data in one frame of the input image, thereby generating an output image. A duty cycle of the inserted black data in the frame is changed according to a result of the motion detection device.

14 Claims, 3 Drawing Sheets

IMAGE DISPLAY SYSTEM

BACKGROUND OF THE INVENTION

1. Field of the Invention

The present invention generally relates to an image display system, and more particularly to an image display system with average pixel level (APL)-based motion detection and black data insertion.

2. Description of Related Art

An organic light-emitting diode (OLED) display is made of OLEDs in which an emissive electroluminescent layer (situated between two electrodes) is a film of organic compound that emits light in response to an electric current.

Compared to the liquid-crystal display (LCD), the OLED display has better power efficiency and less thickness because no backlight is needed. The OLED display provides a greater contrast ratio and wider viewing angle because OLED pixels emit light directly. The OLED display also provides a deeper black level, since a black OLED display emits no light. Further, the OLED display also has a much faster response time than the LCD.

Some OLED displays, however, suffer motion blur due to sample-and-hold effect even with instant panel response time. The sample-and-hold effect means that frames are statistically displayed until next refresh, while eyes are constantly moving when tracking moving objects. Therefore, eyes are in a different position at the beginning of a refresh than at the end of a refresh, thereby causing motion blur as perceived by retinas.

A need has thus arisen to propose a novel scheme to overcome drawbacks of the conventional OLED displays.

SUMMARY OF THE INVENTION

In view of the foregoing, it is an object of the embodiment of the present invention to provide an image display system capable of substantially suppressing motion-induced blur in a display while maintaining static image brightness.

According to one embodiment, an image display system includes a motion detection device and a black data insertion device. The motion detection device detects motion of an object in an input image. The black data insertion device inserts black data in one frame of the input image, thereby generating an output image. A duty cycle of the inserted black data in the frame is changed according to a result of the motion detection device.

DETAILED DESCRIPTION OF THE INVENTION

Figure 1:
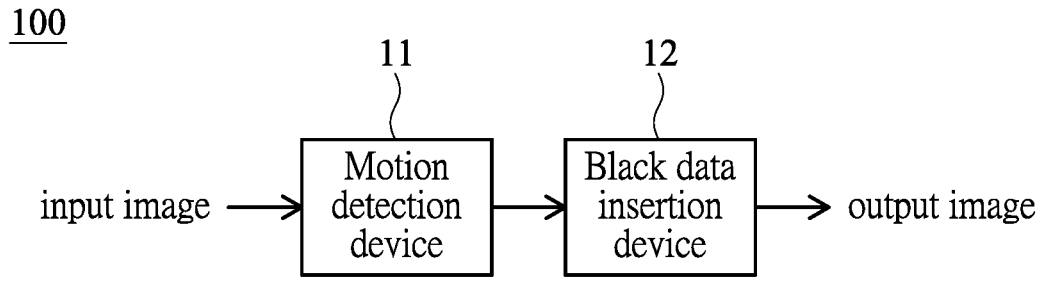
FIG. 1 shows a block diagram illustrating an image display system adaptable to an organic light-emitting diode (OLED) display according to one embodiment of the present invention.

FIG. 1 shows a block diagram illustrating an image display system 100 adaptable to an organic light-emitting diode (OLED) display according to one embodiment of the present invention. The blocks of the image display system 100 may be performed by hardware, software or their combinations such as a digital image processor.

In the embodiment, the image display system 100 may include a motion detection device 11 configured to detect a position change (i.e., motion) of an object in an input image, which may, for example, be composed of red (R), green (G) and blue (B) (color) signals.

Figure 2:
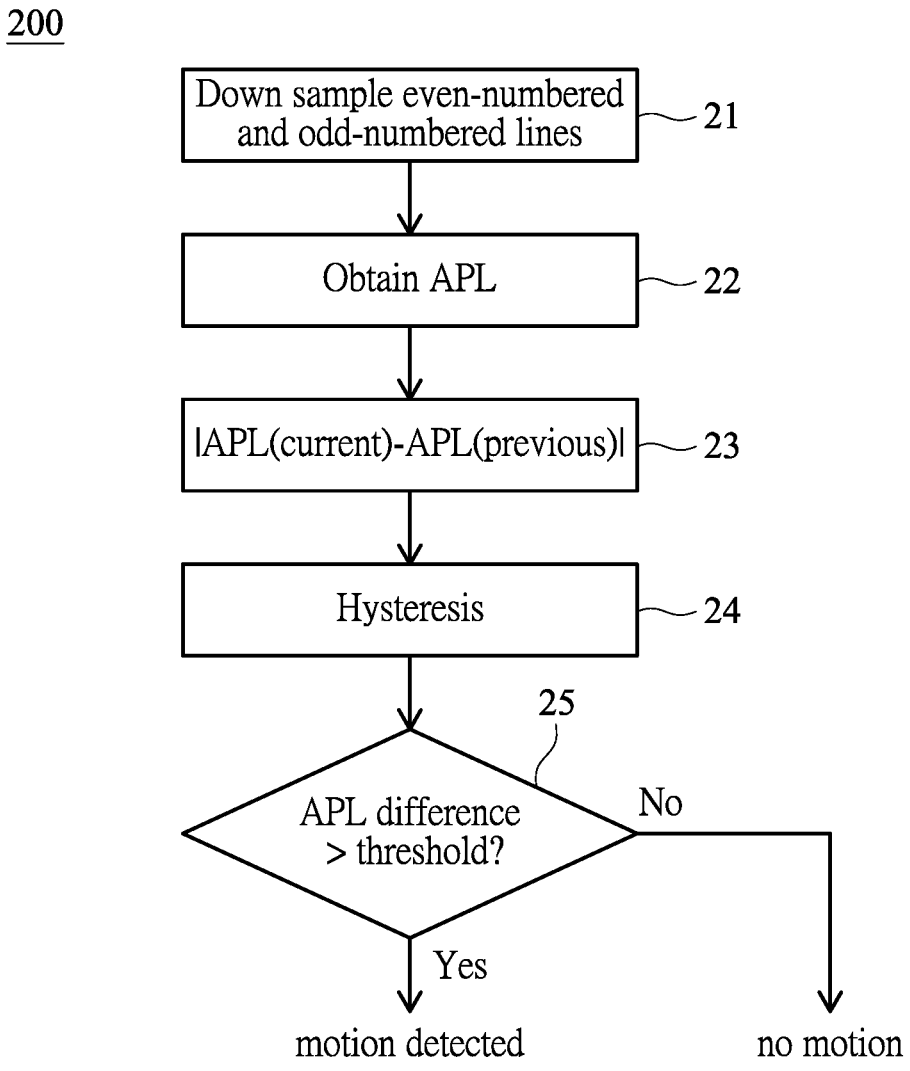
FIG. 2 shows a flow diagram illustrating a motion detection method performed by the motion detection device according to a first embodiment of the present invention.

According to one aspect of the embodiment, the motion detection device 11 may detect motion according to average pixel level (APL) of the input image, and may therefore be called APL-based motion detection device in the embodiment. FIG. 2 shows a flow diagram illustrating a motion detection method 200 performed by the motion detection device 11 according to a first embodiment of the present invention.

In step 21, even-numbered lines and odd-numbered lines of the input image are down sampled respectively. Specifically, the even-numbered line may be down sampled by taking even-numbered pixels each having a maximum brightness of the color signal, that is, Max(R,G,B). The odd-numbered line may be down sampled by taking odd-numbered pixels each having a minimum brightness of the color signal, that is, Min(R,G,B).

In step 22, an average value (i.e., APL) or a sum value of the down sampled even-numbered lines and odd-numbered lines of a frame (of the input image) may be obtained. Next, in step 23, a (positive) difference between APL of a current frame and APL of a previous frame (which may be temporarily stored in a storage device such as double data rate (DDR) synchronous dynamic random-access memory (SDRAM)) may be obtained.

The motion is detected when the (APL) difference is greater than a predetermined (first) threshold (step 25), otherwise no motion is detected. In the embodiment, before or after comparing the difference with the threshold, a hysteresis mechanism (step 24) may be optionally performed to protect transitional motion.

Figure 3:
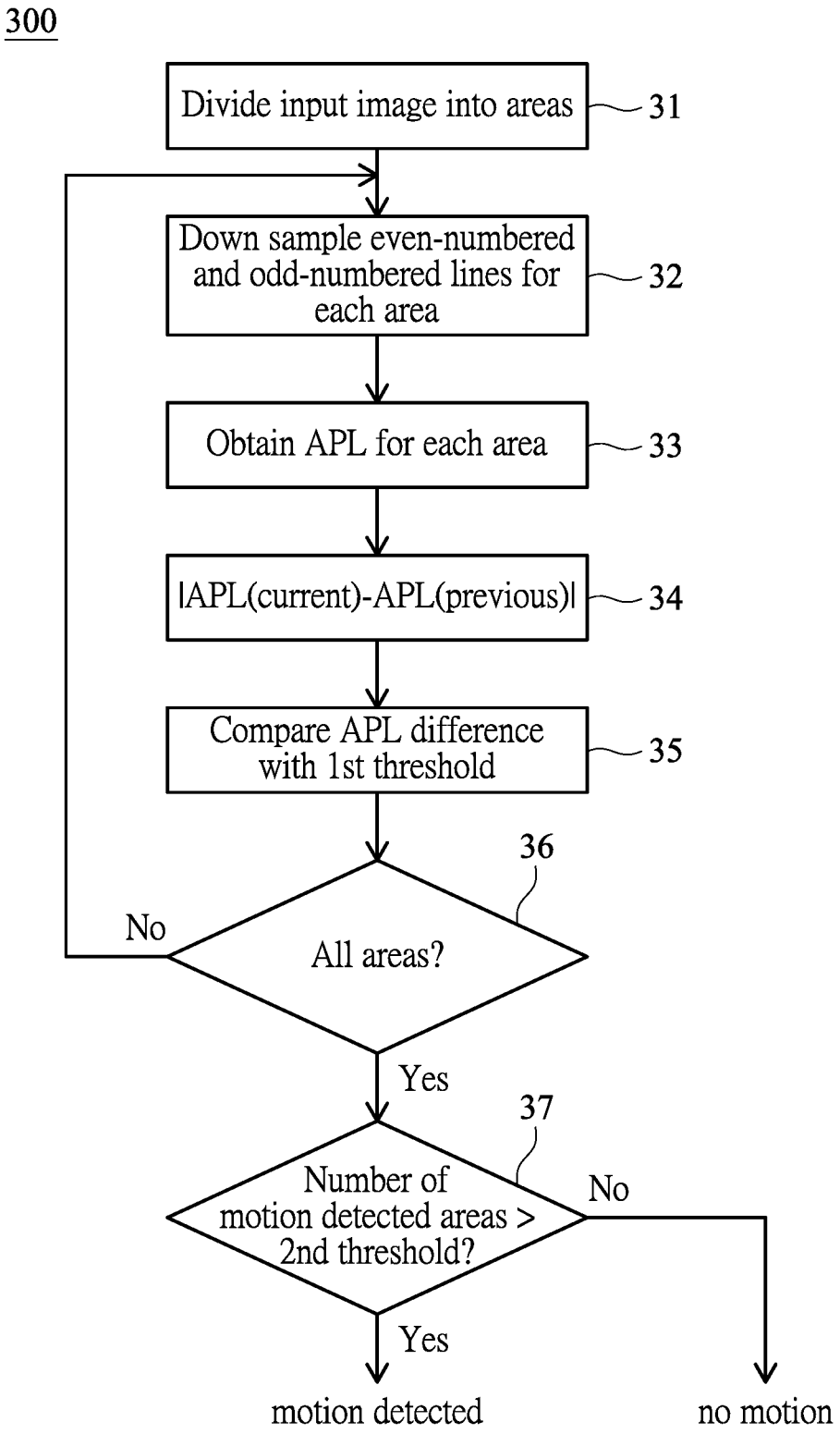
FIG. 3 shows a flow diagram illustrating a motion detection method performed by the motion detection device according to a second embodiment of the present invention.

FIG. 3 shows a flow diagram illustrating a motion detection method 300 performed by the motion detection device 11 according to a second embodiment of the present invention.

In step 31, the input image (or the frame) may be divided into a plurality of areas. In one embodiment, the input image is divided into four areas. Compared to the flow of FIG. 2 that does not divide the input image into areas, the flow of FIG. 3 may achieve better accuracy with less detection miss.

In step 32, for each area, even-numbered lines and odd-numbered lines of the input image are down sampled respectively. Specifically, the even-numbered line may be down sampled by taking pixels at intervals of two and taking the color signals by turns. For example, down sampled pixels of the second line may include R(2,2), G(4,2), B(6,2), R(8,2), G(10,2), B(12,2), . . . . The odd-numbered line may be down sampled by taking pixels at intervals of three and taking the color signals by turns. For example, down sampled pixels of the first line may include R(1,1), G(4, 1), B(7,1), R(10,1), G(13,1), B(16,1), . . . . Accordingly, dithering effect may be substantially reduced.

In step 33, for each area, every two adjacent down sampled pixels (of the down sampled even-numbered lines and odd-numbered lines) are averaged to result in intermediate values. For example, R(2,2) and G(4,2) are averaged to result in an intermediate value, and B(6.2) and R(8,2) are averaged to result in another intermediate value. Subsequently, an average value (i.e., APL) or a sum value of the intermediate values may be obtained. Next, in step 34, for each area, a (positive) difference between APL of a current frame and APL of a previous frame (which may be temporarily stored in a storage device such as double data rate (DDR) synchronous dynamic random-access memory (SDRAM)) may be obtained.

A motion detected area is decided when the (APL) difference is greater than a predetermined (first) threshold (step 35), otherwise no motion detected area is decided. The steps 32-35 are repeated until all areas have been executed (step 36).

The (local) motion is detected when a number of the motion detected areas is greater than a predetermined (second) threshold (step 37), otherwise no (local) motion is detected.

Referring back to FIG. 1, the image display system 100 of the embodiment may include a black data insertion device 12 configured to insert black data in one frame of the input image, thereby generating an output image. According to another aspect of the embodiment, a duty cycle (which may be commonly expressed as a percentage or a ratio) of the inserted black data in one frame may be changed according to a result of the motion detection device 11. Specifically, the duty cycle of the inserted black data may be gradually increased (within a predetermined range) frame by frame when motion is detected by the motion detection device 11. Otherwise, the duty cycle of the inserted black data may be gradually decreased frame by frame when motion is not detected by the motion detection device 11. The black data inserted in the frame may be placed in a position that may vary according to a predetermined pattern.

Figure 4:
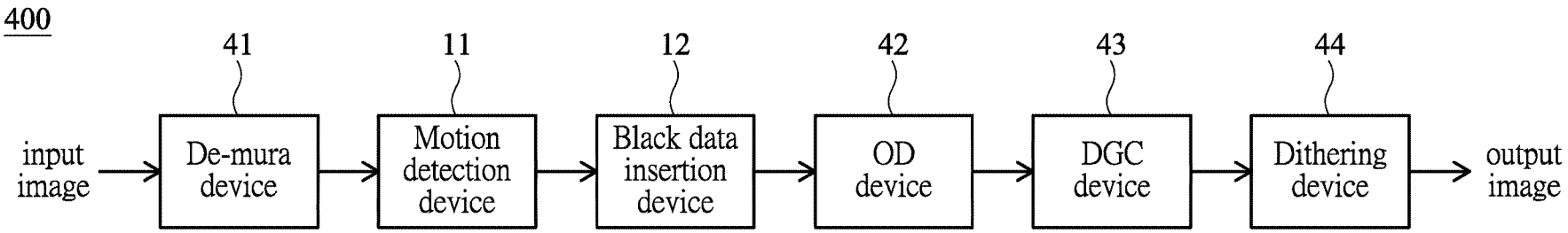
FIG. 4 shows a block diagram illustrating an image display system according to an alternative embodiment of the present invention.

FIG. 4 shows a block diagram illustrating an image display system 400 according to an alternative embodiment of the present invention. The image display system 400 of FIG. 4 is similar to the image display system 100 of FIG. 1 with the following differences. Specifically, prior to or after the motion detection device 11, the image display system 400 may further include a de-mura device 41 configured to adjust luminance and/or chromaticity of each OLED pixel to produce uniform appearance on the display.

The image display system 400 may further include an overdrive (OD) device 42 disposed after the de-mura device 41 or the black data insertion device 12, and may be configured to compensate for slow temporal response of the OLED display. The image display system 400 may further include a digital gamma correction (DGC) device 43 disposed after the OD device 42, and may be configured to perform a nonlinear operation used to encode and decode luminance or tristimulus values in the output image. The image display system 400 may further include a dithering device 44 disposed after the DGC device 43, and may be an intentionally applied form of noise used to randomize quantization error, preventing large-scale patterns in the output image. Conventional techniques may be adapted to the de-mura device 41, the OD device 42, the DGC device 43 and the dithering device 44, details of which are thus omitted for brevity.

Although specific embodiments have been illustrated and described, it will be appreciated by those skilled in the art that various modifications may be made without departing from the scope of the present invention, which is intended to be limited solely by the appended claims.

What is claimed is:

1. An image display system, comprising:

a motion detection device that detects motion of an object in an input image; and a black data insertion device that inserts black data in one frame of the input image, thereby generating an output image;

wherein a duty cycle of the inserted black data in the frame is changed according to a result of the motion detection device;

wherein the duty cycle of the inserted black data is gradually increased frame by frame when motion is detected by the motion detection device.

2. The system of claim 1, wherein the motion detection device detects motion according to average pixel level (APL) of the input image.

3. The system of claim 1, wherein the motion detection device performs the following steps:

down sampling the input image;

obtaining an average or sum value of the down sampled input image; and determining a difference of the average or sum value between a current frame and a previous frame;

wherein motion is detected when the difference is greater than a predetermined threshold, otherwise no motion is detected.

4. The system of claim 3, wherein the input image is down sampled by the following steps:

down sampling even-numbered lines and odd-numbered lines of the input image respectively;

wherein the even-numbered line is down sampled by taking even-numbered pixels each having a maximum brightness of a color signal, and the odd-numbered line is down sampled by taking odd-numbered pixels each having a minimum brightness of the color signal.

5. The system of claim 1, wherein the motion detection device performs the following steps:

dividing the input image into a plurality of areas;

down sampling the areas of the input image respectively;

averaging every two adjacent down sampled pixels to result in intermediate values for each area;

obtaining an average or sum value of the intermediate values for each area; and determining a difference of the average or sum value between a current frame and a previous frame for each area, wherein a motion detected area is decided when the difference is greater than a predetermined first threshold;

wherein motion is detected when a number of the motion detected areas is greater than a predetermined second threshold, otherwise no motion is detected.

6. The system of claim 5, wherein the input image is down sampled by the following steps:

down sampling even-numbered lines and odd-numbered lines of the areas of the input image respectively;

wherein the even-numbered line is down sampled by taking pixels at intervals and taking color signals by turns, and the odd-numbered line is down sampled by taking pixels at intervals and taking the color signals by turns.

7. The system of claim 6, wherein the even-numbered line is down sampled by taking pixels at intervals of two, and the odd-numbered line is down sampled by taking pixels at intervals of three.

8. The system of claim 1, wherein the black data inserted in the frame is placed in a position that varies according to a predetermined pattern.

9. The system of claim 1, further comprising:

a de-mura device, disposed prior to or after the motion detection device, for adjusting luminance or chromaticity of each pixel of a display to produce uniform appearance on the display.

10. The system of claim 9, further comprising:

an overdrive device, disposed after the de-mura device or the black data insertion device, for compensating for slow temporal response of the display.

11. The system of claim 10, further comprising:

a digital gamma correction device, disposed after the overdrive device, for performing a nonlinear operation used to encode and decode luminance or tristimulus values in the output image.

12. The system of claim 11, further comprising:

a dithering device, disposed after the digital gamma correction device, being a form of noise used to randomize quantization error.

13. The system of claim 1, wherein the image display system is adaptable to an organic light-emitting diode (OLED) display.

14. An image display system, comprising:

a motion detection device that detects motion of an object in an input image; and a black data insertion device that inserts black data in one frame of the input image, thereby generating an output image;

wherein a duty cycle of the inserted black data in the frame is changed according to a result of the motion detection device;

wherein the duty cycle of the inserted black data is gradually decreased frame by frame when motion is not detected by the motion detection device.

* * * * *